US007937035B2

(12) United States Patent
Maruyama

(10) Patent No.: US 7,937,035 B2
(45) Date of Patent: May 3, 2011

(54) IMAGE FORMING APPARATUS INCLUDING CLEANING UNIT PROVIDED WITH CLEANING MEMBER HAVING FREE END FACING UPWARD AND FRICTION REDUCING UNIT, AND IMAGE FORMING METHOD

(75) Inventor: Akihisa Maruyama, Kanagawa (JP)

(73) Assignee: Fuji Xerox Co., Ltd, Tokyo (JP)

( * ) Notice: Subject to any disclaimer, the term of this patent is extended or adjusted under 35 U.S.C. 154(b) by 0 days.

(21) Appl. No.: 12/212,377

(22) Filed: Sep. 17, 2008

(65) Prior Publication Data

US 2009/0245904 A1 Oct. 1, 2009

(30) Foreign Application Priority Data

Mar. 26, 2008 (JP) ..... 2008-081765

(51) Int. Cl.
*G03G 21/00* (2006.01)

(52) U.S. Cl. ..... 399/350; 399/102; 399/174

(58) Field of Classification Search ..... 399/50, 399/71, 102, 349, 350, 351
See application file for complete search history.

(56) References Cited

U.S. PATENT DOCUMENTS 5,991,568 A * 11/1999 Ziegelmuller et al. ..... 399/102
2003/0235419 A1* 12/2003 Ota ..... 399/50
2004/0126148 A1* 7/2004 Iwai et al. ..... 399/296
2006/0024100 A1* 2/2006 Ohta et al. ..... 399/350

FOREIGN PATENT DOCUMENTS

| | | |
|---|---|---|
| JP | 4030187 | 2/1992 |
| JP | 2003241486 A | 8/2003 |
| JP | 2004333789 A | 11/2004 |
| JP | 2004-341240 | 12/2004 |
| JP | 2005004051 A | 1/2005 |
| JP | 2006-208882 | 8/2006 |

* cited by examiner

*Primary Examiner* — David M Gray
*Assistant Examiner* — Roy Yi
(74) *Attorney, Agent, or Firm* — Morgan, Lewis & Bockius LLP

(57) ABSTRACT

An image forming apparatus including: a rotatable image-carrier; a charging unit that contacts and charges a surface of the image-carrier; an exposing unit that exposes the surface and forms a latent-image; a developing unit that develops the latent-image with a developer; a transfer unit that transfers a developed-toner-image onto a transfer-receiving member; a cleaning unit that is provided with a plate shaped cleaning member having a free end that faces upwards a corner portion of the free end contacting the surface, the cleaning member cleaning off developer remaining on the surface after transfer, and a developer pooling member provided between the cleaning member and the transfer unit, that temporarily pools the cleaned off developer at the free end; and a friction-coefficient reducing unit that reduces a friction-coefficient at the surface, and that reduces the friction-coefficient during non-image forming period to less than that during image forming period is provided.

14 Claims, 10 Drawing Sheets

IMAGE FORMING APPARATUS INCLUDING CLEANING UNIT PROVIDED WITH CLEANING MEMBER HAVING FREE END FACING UPWARD AND FRICTION REDUCING UNIT, AND IMAGE FORMING METHOD

CROSS-REFERENCE TO RELATED APPLICATION

This application claims priority under 35 U.S.C 119 from Japanese Patent Application No. 2008-081765 filed Mar. 26, 2008.

BACKGROUND

1. Technical Field

The present invention relates to an image forming apparatus and an image forming method.

2. Related Art

In ordinary electrophotographic image forming apparatuses, typified by copying machines and laser printers, toner images are formed on the surface of an image carrier (photoreceptor drum or the like) in a charging process, an exposure process, and a developing process. These toner images are then transferred and fixed onto a member to be transferred in a transfer process and a fixing process. Any developer or the like that remains on the surface of the image carrier after the transfer process is removed (cleaned) in a cleaning process.

SUMMARY

An aspect of the present invention is an image forming apparatus including: a rotatable image carrier; a charging unit that contacts a surface of the image carrier and charges the surface of the image carrier; an exposing unit that exposes the surface of the image carrier and forms a latent image; a developing unit that develops the latent image formed on the surface of the image carrier with a developer; a transfer unit that transfers a developed toner image onto a transfer receiving member; a cleaning unit that is provided with: a plate shaped cleaning member having a free end that faces upward, a corner portion of the free end contacting the surface of the image carrier, the cleaning member cleaning off developer remaining on the surface of the image carrier after transfer by the transfer unit, and a developer pooling member provided between the cleaning member and the transfer unit, that temporarily pools the cleaned off developer at the free end of the cleaning member; and a friction coefficient reducing unit that reduces a friction coefficient at the surface of the image carrier and that reduces the coefficient of friction during a non-image forming period to less than a coefficient of friction during an image forming period.

BRIEF DESCRIPTION OF THE DRAWINGS

Exemplary embodiments of the present invention will be described in detail based on the following figures wherein.

DETAILED DESCRIPTION

First Exemplary Embodiment

Figure 1:
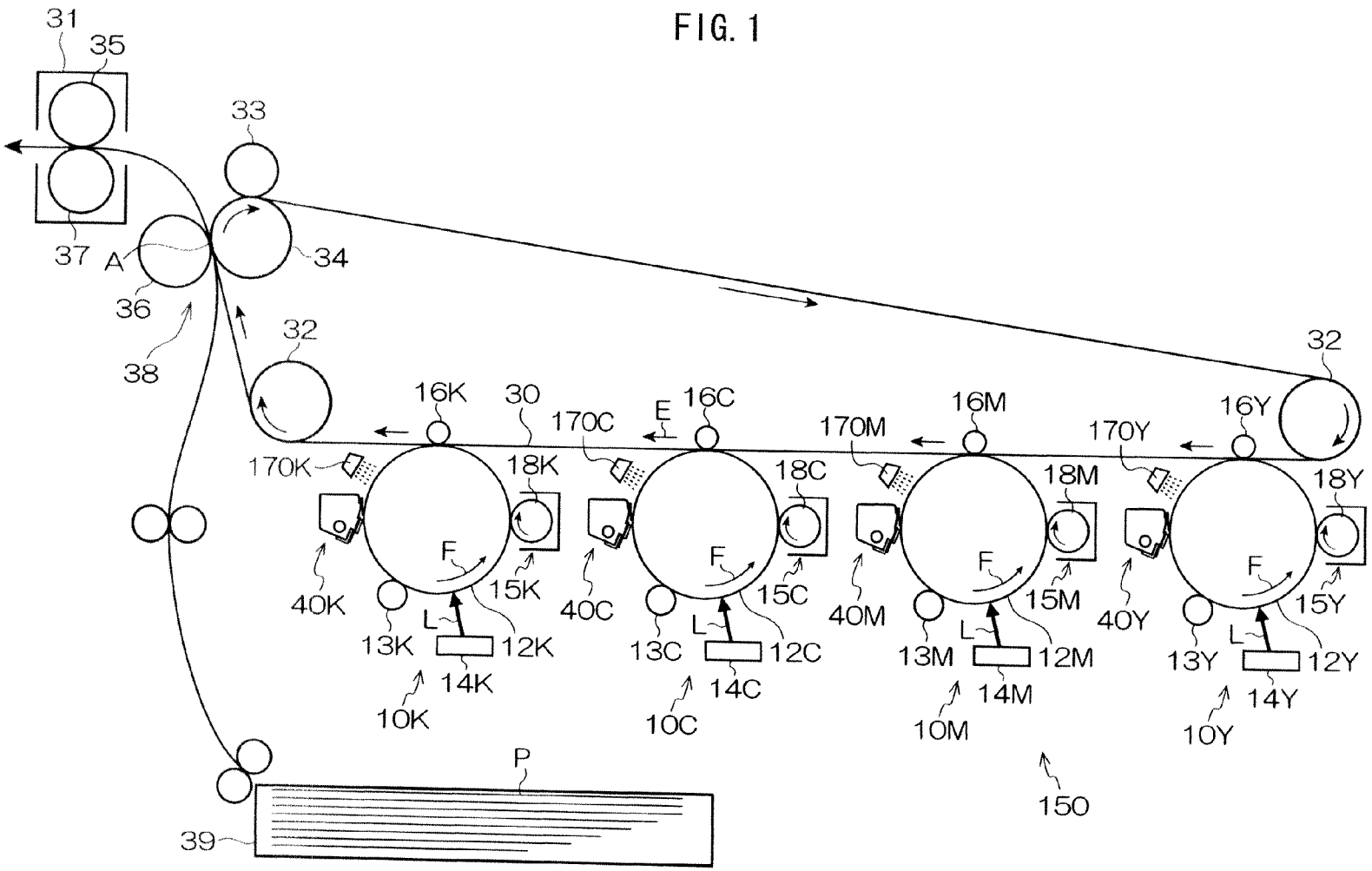
FIG. 1 is a schematic diagram showing a configuration of an image forming apparatus of a first exemplary embodiment of the present exemplary embodiment.

Explanation will now be given of a first exemplary embodiment of the image forming apparatus of the present invention, with reference to the figures. FIG. 1 shows schematically the configuration of an image forming apparatus 150. The image forming apparatus 150, as shown in FIG. 1, is provided with an endless belt shaped intermediate transfer belt 30 (an example of a member to be transferred) entrained around plural rollers 32 and driven by a motor (not shown in the figures) to be transported in the direction of arrow E. There are plural image forming units 10 (described in detail later) disposed along the transporting direction E of the intermediate transfer belt 30.

The image forming units 10 in the present exemplary embodiment correspond to color image forming, the image forming units 10Y, 10M, 10C, and 10K are provided respectively forming toner images corresponding to four colors, Yellow (Y), Magenta (M), Cyan (C), and Black (K). When it is necessary to discriminate Y, M, C, K below then the labels Y, M, C, and K will be given in the explanation, but when discrimination is not required the labels Y, M, C, and K will be omitted.

Each of the image forming units 10 (it should be noted that the configuration of each of the image forming units 10 are similar, and so the suffixes denoting the color of the units are omitted in the explanation) is provided with a photoreceptor drum 12 serving as an example of an image carrier (referred to below simply as photoreceptor 12). The photoreceptor 12 rotates at a specific speed in the direction of arrow F while contacting the intermediate transfer belt 30.

Figure 2:
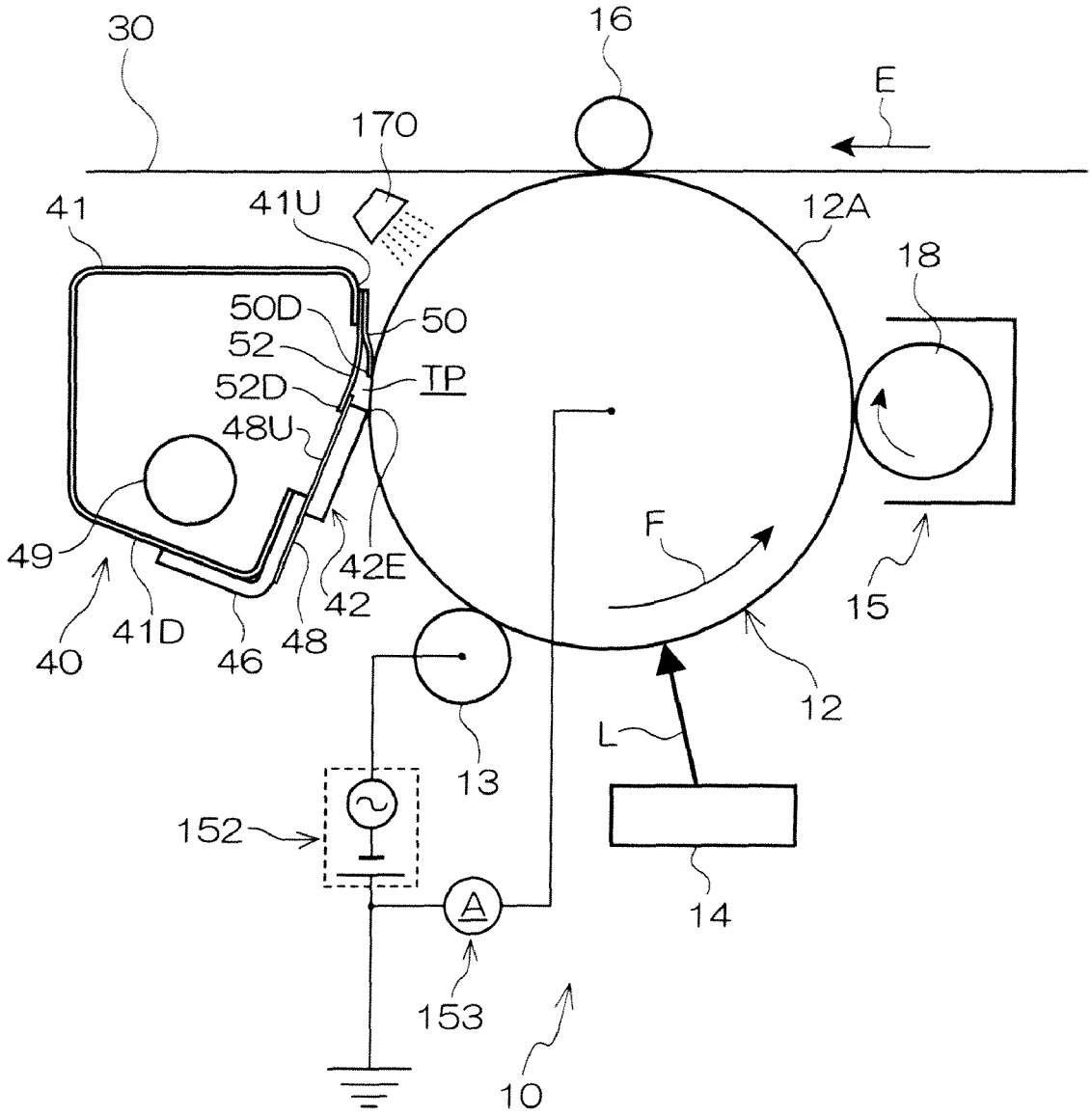
FIG. 2 is a schematic diagram showing a configuration of an image forming unit of the first exemplary embodiment of the present invention.

There is a contact type charger (charging roll) 13 provided at the periphery of the photoreceptor 12, as shown in FIG. 2, for charging the photoreceptor 12. The charging roll 13 is a conductive roll, and is disposed so that the outer peripheral surface thereof contacts the surface photoreceptor surface 12A) of the photoreceptor 12. The charging roll 13 is rotatable so as to follow the rotation of the photoreceptor 12. An oscillating voltage which is formed by a direct current voltage being superimposed on an alternating current voltage from a charging power source 152 is applied to the charging roll 13, and the photoreceptor surface 12A is thereby charged to a uniform specific electric potential. In the present exemplary embodiment, the oscillating voltage applied to the charging roll 13 is negative voltage, and so the photoreceptor surface 12A is charged with a negative voltage by the charging roll 13.

An exposing unit 14 is provided downstream in the rotation direction F of the photoreceptor 12 from the charging roll 13. The exposing unit 14 is configured with an LED array in which plural LEDs (Light Emitting Diodes) are arranged, and the exposing unit 14 irradiates a light beam L which is modulated with image data onto the photoreceptor surface 12A that has been uniformly charged by the charging roll 13. As the result, a latent electrostatic image is thereby formed on the photoreceptor surface 12A.

A developing unit 15 is provided downstream in the rotation direction F of the photoreceptor 12 from the exposing unit 14. The developing unit 15 stores a developer that includes negative charged toner, and a lubricant (for example zinc stearate or the like) charged with the opposite polarity to the toner (i.e. positive). There is a developing roll 18 provided in the developing unit 15 for supplying developer onto the photoreceptor surface 12A. The latent electrostatic image formed on the photoreceptor surface 12A is developed by the developer being supplied from the developing unit 15, thereby forming a toner image.

A transfer roll 16 is provided downstream in the rotation direction F of the photoreceptor 12 from the developing unit 15. A voltage of the opposite polarity to that of the toner is applied to the transfer roll 16, and the toner on the photoreceptor surface 12A is transferred onto the intermediate transfer belt 30.

Toner images each of different colors that have been formed on each of the image forming units 10 are respectively transferred onto the intermediate transfer belt 30 so as to be superimposed on each other. A color toner image is thereby formed on the intermediate transfer belt 30.

There is an eraser lamp 170 provided downstream in the rotation direction F of the photoreceptor 12 from the transfer roll 16. The eraser lamp 170 is provided for erasing charge from the photoreceptor surface 12A. The photoreceptor surface 12A after the toner image has been transferred is irradiated from the eraser lamp 170, and erasing charge is carried out on the photoreceptor surface 12A by the light.

There is a cleaning device 40 (cleaning unit), which is provided with a cleaning blade 42 (referred to below as blade 42), provided downstream in the rotation direction F of the photoreceptor 12 from the transfer roll 16. The cleaning device 40 is for cleaning residual toner that was not transferred onto the intermediate transfer belt 30 by the transfer roll 16 and has remained on the photoreceptor surface 12A and, and for cleaning electrical discharge generated substance that is generated during electrical discharge and adheres to the photoreceptor surface 12A. The residual toner and electrical discharge generated substance on the photoreceptor surface 12A is cleaned off by the cleaning device 40.

There is a transfer device 38 provided downstream in the conveying direction E of the intermediate transfer belt 30 from the four image forming units 10. The transfer device 38 is an example of a transfer unit and includes two opposing rollers 34 and 36. The toner image formed on the intermediate transfer belt 30 is transported between the rollers 34 and 36, the toner image on the intermediate transfer belt 30 is transferred onto paper P that is also transported between the rollers 34 and 36 from a paper tray 39 provided in the image forming apparatus 150.

There is a fixing device 31, including a pressure roller 37 and a heat roller 35, provided as a fixing unit on the transporting path of the paper P. The paper P transported into the fixing device 31 is nipped and transported by the pressure roller 37 and the heat roller 35, and the toner on the paper P is fused and fixed to the paper P. The desired image is thereby formed on the paper P. The paper P on which the image is formed is then discharged from the image forming apparatus 150.

There is a belt cleaning device 33 for the intermediate transfer belt disposed on the intermediate transfer belt 30. Toner remaining on the intermediate transfer belt 30, which was not transferred onto paper P by the transfer device 38, is collected by the belt cleaning device 33.

(Cleaning Device)

A detailed explanation will now be given of the cleaning device 40. There is, as shown in FIG. 2, a housing 41 provided in the cleaning device 40, the housing 41 having an opening in the wall thereof that faces the photoreceptor 12. There is a toner pooling sheet 52 and a receiving seal 50 attached to an upper edge portion 41U of this opening (at the edge portion on the upstream side in the rotation direction F of the photoreceptor 12). In the present exemplary embodiment, the developer pooling member is configured with the flexible toner pooling sheet 52 and the receiving seal 50. A blade plate 48 and a blade 42 are attached to the lower wall face 41D of the housing 41 (at the wall face on the downstream side in the rotation direction F of the photoreceptor drum 12) via an L-shaped cross-section fixing 46 which is attached to the lower wall face 41D of the housing 41 with screws or the like. The blade 42, is formed as an example of a resilient body in a rectangular block shape (plate shape) from rubber (such as, for example, a urethane rubber, natural rubber, an isoprene rubber, or a chloroprene rubber). The blade 42 extends in the opposite direction to the rotation direction F of the photoreceptor 12, and contacts the photoreceptor surface 12A with its free end edge 42E (in the present exemplary embodiment, the free end faces upward relative to vertical). Namely, the blade 42 is disposed so that the edge 42E protrudes out to span across to the photoreceptor 12. Residual toner and electrical discharge generated substance remaining on the photoreceptor surface 12A is separated and cleaned off therefrom by the edge 42E. The free end facing upward relative to vertical is meant that the free end of the blade 42 is positioned above the fixed end (the end on the side attached to the blade plate 48) of the blade 42 in the vertical direction. Also, since the free end of the blade 42 faces upward, gravity acts on the separated residual toner etc. so as to pool the toner etc. in a region formed between the distal end surface of the free end and the photoreceptor surface 12A.

The width of the blade 42 (the dimension along the rotational axial direction of the photoreceptor drum 12) is set to be the width of the image forming region of the photoreceptor surface 12A (the dimension along the rotational axial direction of the photoreceptor drum 12), or a greater width. Consequently the residual toner and electrical discharge generated substance from the image forming region of the photoreceptor surface 12A is separated by the blade 42 and cleaned off from the photoreceptor surface 12A.

The front face of the blade plate 48 (the face on the photoreceptor drum 12 side) in one end side joins together with the back face of the blade 42 (the face on the opposite side to that of the photoreceptor drum 12), and the back face of the blade plate 48 in the other end side is fixed, with screws or other fastening, to one piece of the fixing 46.

Figure 3:
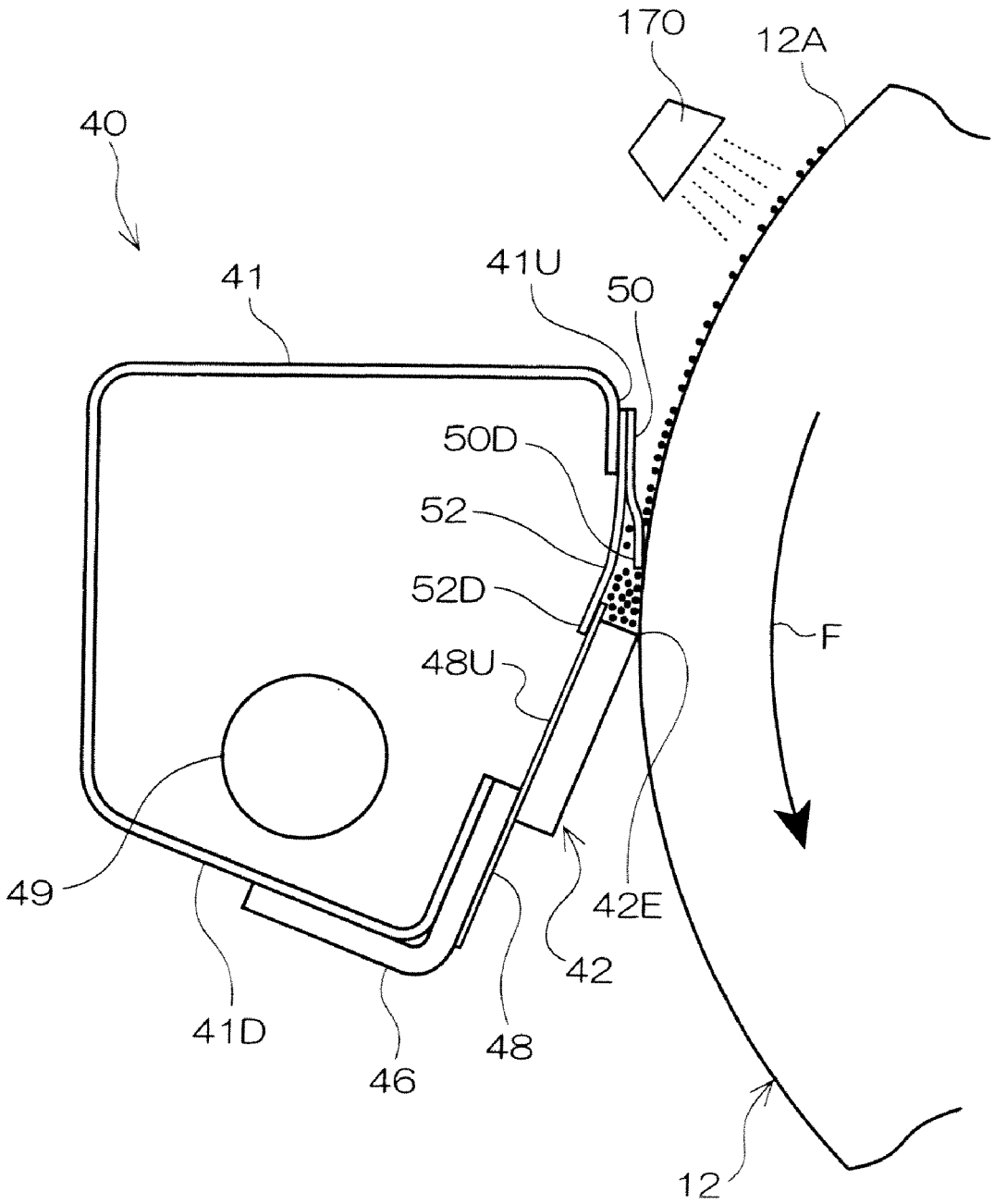
FIG. 3 is an explanatory diagram of the process by which toner scraped off a photoreceptor drum pools in a toner pool region of a cleaning device.

As shown in FIGS. 2 and 3, the receiving seal 50 and the toner pooling sheet 52 are superimposed on each other at one end portions thereof (the upper ends in FIG. 2) and fixed to the upper edge portion 41U. The receiving seal 50 is disposed more toward the photoreceptor drum 12 side than the toner pooling sheet 52, and a lower end portion 50D of the receiving seal 50 contacts the photoreceptor surface 12A. A lower end portion 52D of the toner pooling sheet 52 contacts a back face 48U of the blade plate 48. The residual toner separated (removed) from the photoreceptor surface 12A by the edge 42E is thereby received by the receiving seal 50, and pools within a toner pooling region TP formed by the photoreceptor surface 12A, the distal end surface of the free end of the blade 42, the upper edge portion of the blade plate 48, the receiving seal 50, and the toner pooling sheet 52 (see FIGS. 2 and 3). The free end of the blade 42 is covered by the toner due to the toner pool being formed by the toner (residual toner) pooling within the toner pooling region TP.

Figure 4:
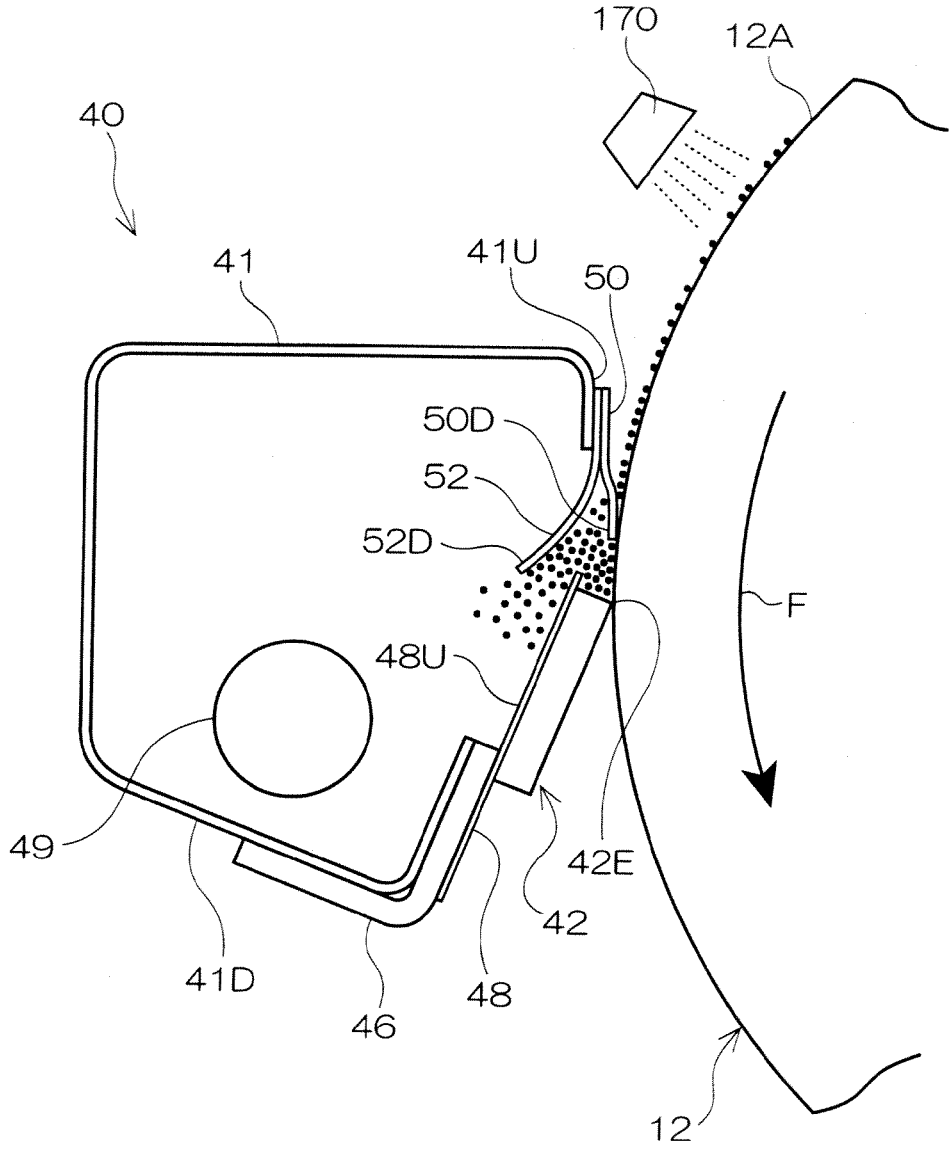
FIG. 4 is an explanatory diagram of the process by which toner that has built up in a toner pool portion of a cleaning device is removed.

When the amount of toner pooled within the toner pooling region TP exceeds a particular amount, as shown in FIG. 4, the pressure from the pooled toner (toner pool) presses against the toner pooling sheet 52 and the lower edge portion 52D separates from the back face of the blade plate 48. Consequently the toner pooled in the toner pooling region TP is discharged to within the housing 41 before it becoming excessively compacted (high-pressed). Therefore, after toner has been pooled within the toner pooling region TP, the amount of toner within the toner pooling region TP becomes substantially uniform in the photoreceptor axial direction, no matter whether positioned at a non-image portion or at an image portion of an image pattern.

An opening may be provided in the toner pooling sheet 52, such that the toner within the toner pooling region TP can be discharged to within the housing 41 through the opening. The compacted state of toner within the toner pooling region TP may be relieved by separation of the back face 48U from the lower edge portion 52D and by the opening.

The toner discharged from within the toner pooling region TP to inside the housing 41 is pushed in one direction side within the housing 41 by a conveying member 49, which includes spiral vanes, provided within the housing 41 and serving as a conveying member, and the toner is discharged from a non-illustrated outlet to be conveyed to a separately provided toner collection device.

(Controller)

Figure 5:
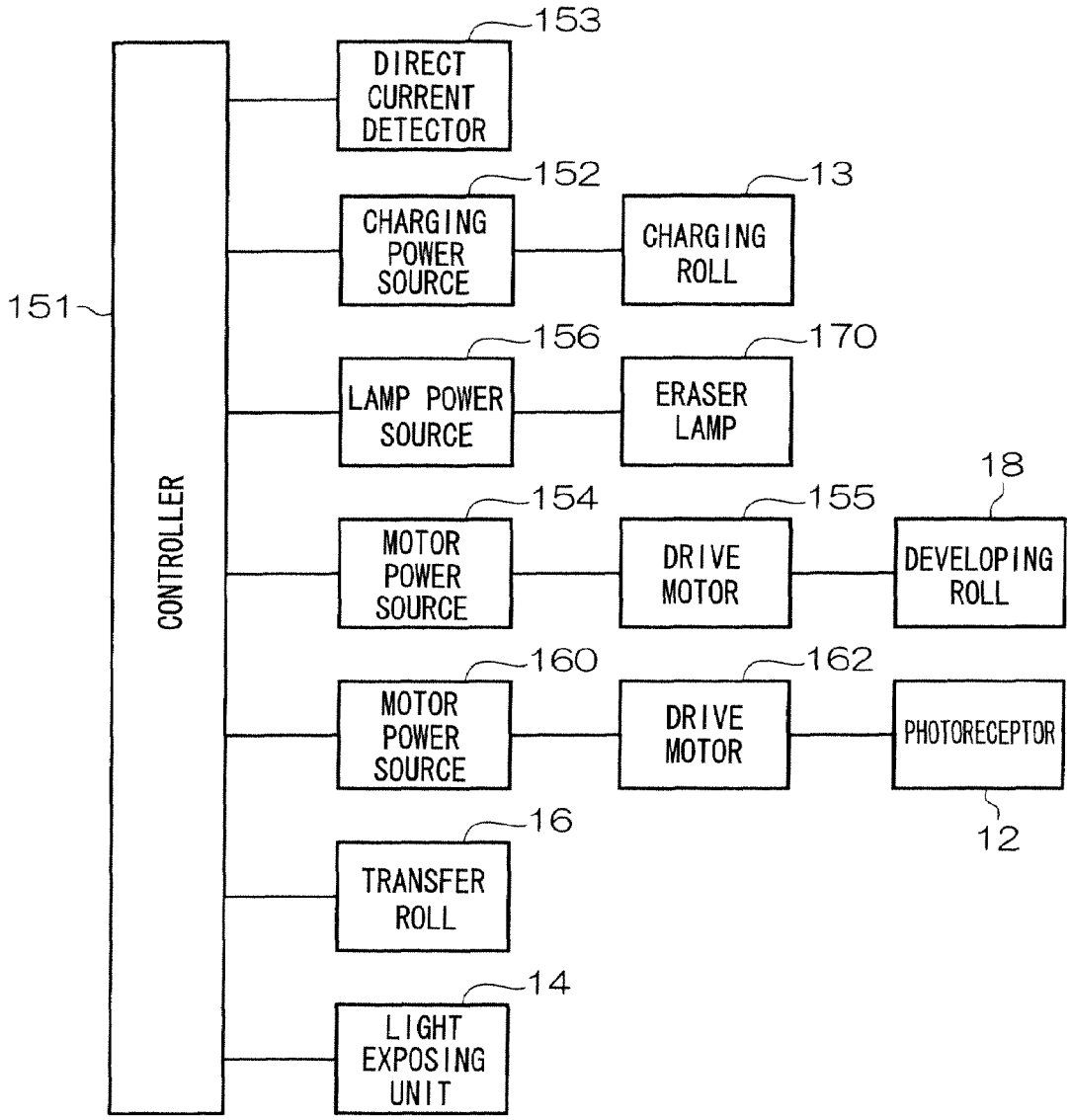
FIG. 5 is a block diagram showing the relationship between a controller and each component of an image forming apparatus.

The image forming apparatus 150 is provided with a controller 151 for controlling each device therein, as shown in FIG. 5. The controller 151 controls: a motor power source 160 that applies a voltage to a drive motor 162 for rotating the photoreceptor drum 12; a motor power source 154 that applies a voltage to a drive motor 155 for rotating the developing roll 18; a developing bias power source (not illustrated) that applies a voltage to developing within the developing unit 15; a power source (not illustrated) that applies a voltage to the exposing unit 14; a motor power source (not illustrated) that applies a voltage to a drive motor (not illustrated) for rotating the transfer roll 16; a charging power source (not illustrated) that charges the transfer roll 16; a charging power source 152; and a lamp power source 156 for the eraser lamp 170. The image forming apparatus 150 is also, as shown in FIG. 2 and FIG. 5, provided with a direct current detector 153. The direct current detector 153 detects the direct current component flowing to the photoreceptor drum 12 by the charging roll 13. The direct current values detected by the direct current detector 153 are sequentially transmitted to the controller 151.

Figure 6:
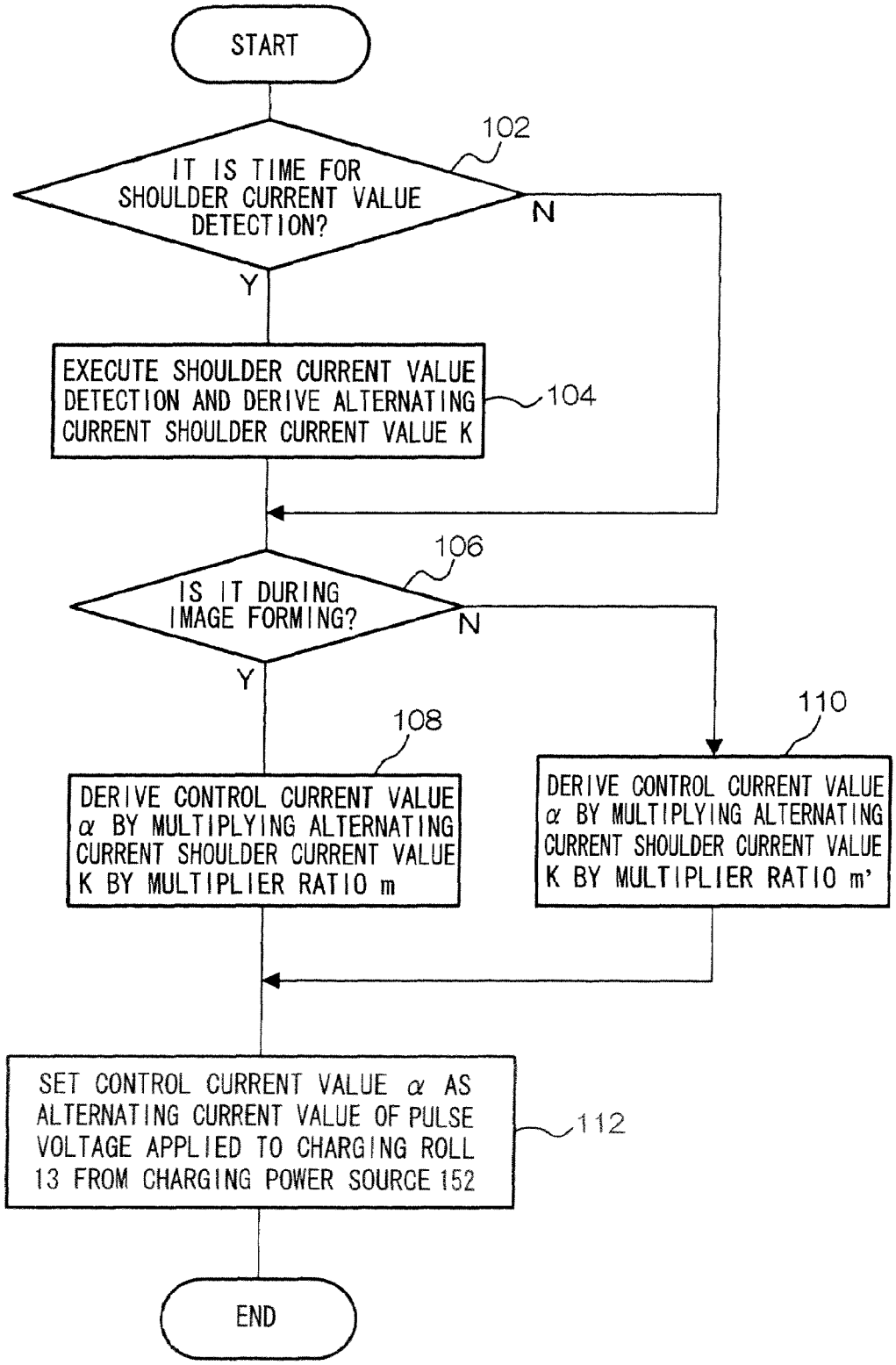
FIG. 6 is a flow chart for operation during non-image forming.

The controller 151 controls the charging power source 152 of the image forming apparatus 150 in accordance with the flow chart shown in FIG. 6, from when the image forming apparatus 150 is switched on (powered on), at every time of the end of one cycle of image forming. First the controller 151 determines at step 102 whether it is time to detect a shoulder current value or not. By the time to detect a shoulder current value here is meant the time when the image forming apparatus 150 is switched on and at timings of every given number of cycles (for example 1000 cycles) of image forming set in advance. When determination at step 102 is that it is time to detect a shoulder current value (Y), the routine proceeds to step 104 and shoulder current value detection (described in detail later) is executed, the alternating current shoulder current value K (referred to below as alternating current shoulder current value) is derived, and the routine proceeds to step 106. If determination at step 102 is that it is not time for shoulder current value detection (N) then the routine proceeds to step 106 with the alternating current shoulder current value K unchanged from the value of the previous image forming cycle. Determination is next made at step 106 as to whether it is an image forming time of the image forming apparatus 150.

(Operation During Image Forming)

When it is determined to be an image forming time (Y) at step 106, the routine proceeds to step 108, and a control current value $\alpha$ is derived from the alternating current shoulder current value K multiplied by a multiplier ratio (extra ratio) m. The routine then proceeds to step 112, and control is carried out such that the alternating current value of the oscillating voltage of the charging power source 152 becomes the control current value $\alpha$. It should be noted that since the multiplier ratio m is a value that changes depending on the thickness of the photoreceptor drum 12, the environmental conditions (temperature, humidity) within the image forming apparatus 150, and the specification of the charging roll 13 (resistance value) and the like, preferable values for the ratio for the various conditions are determined by experimentation in advance, and the optimum value of the ratio is chosen according to the various conditions when the image forming apparatus 150 is used.

(Operation During Non-Image Forming)

When determination at step 106 is that it is a non-image forming time (N), the routine proceeds to step 110, and the control current value $\alpha$ is derived from the alternating current shoulder current value K multiplied by a multiplier ratio m'. It should be noted that multiplier ratio m' is set a value which is lower than multiplier ratio m. The routine proceeds to step 112, and control is carried out such that the alternating current value of the oscillating voltage of the charging power source 152 becomes control current value $\alpha$. Consequently, the control current value $\alpha$ when not image forming becomes lower than the value thereof when image forming, in other words, since the alternating current value of the oscillating voltage that the charging power source 152 applies to the charging roll 13 when not image forming is lower than that when image forming, the electrical discharge stress received by the photoreceptor surface 12A also becomes lower when not image forming than when image forming. The coefficient of friction of the photoreceptor surface 12A is thereby less when not image forming than when image forming. The multiplier ratio m is preferably within the range of 1.2 to 1.4, and in the present exemplary embodiment the multiplier ratio m is set to 1.28. If the multiplier ratio m is 1.28 then the multiplier ratio m' is preferably set to 1.13 (a value 15% lower than multiplier ratio m). In the present exemplary embodiment operation during non-image forming is executed in the interval between formation of one image and formation of another image when carrying out successive image forming, and the interval between formation of one image and formation of another image is determined by detecting the edge of sheet of paper by a non illustrated sensor.

(Shoulder Current Value Detection)

Figure 7:
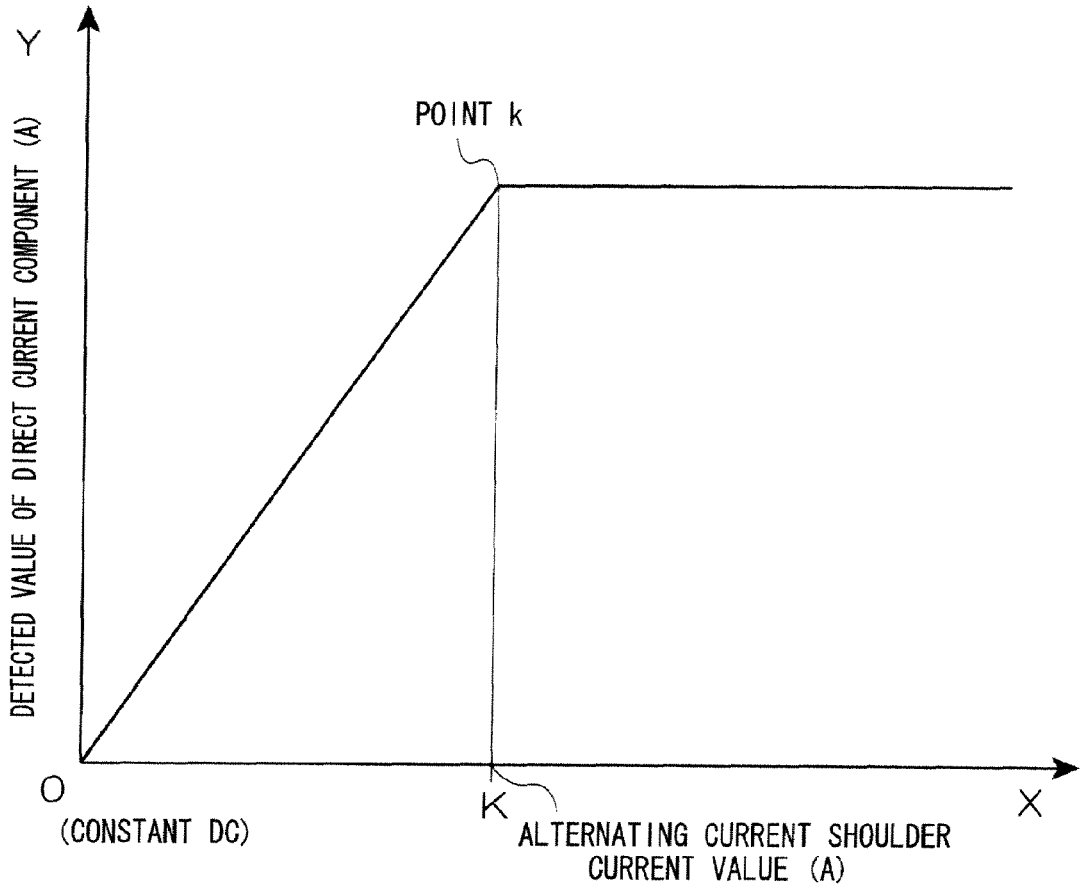
FIG. 7 is a graph showing the relationship between an AC value and a DC value.

The shoulder current value detection mentioned above is, specifically, performed by increasing or decreasing (varying)

the alternating current value of the oscillating voltage (AC+DC voltage), with a state in which the direct current voltage component of the oscillating voltage (AC+DC voltage) applied to the charging roll 13 by the charging power source 152 is held constant (DC voltage constant), the direct current component of the charging roll 13 at this time is detected by the direct current detector 153, the alternating current value at a point k is derived, (see FIG. 7), where there is a sudden change in the relationship between the varied alternating current value and the detected value detected by the direct current detector 153 namely in the present exemplary embodiment, where the direct current value reaches a constant value (saturation). The derived alternating current value is the alternating current shoulder current value K.

(Operation during Later-Rotation)

Figure 8:
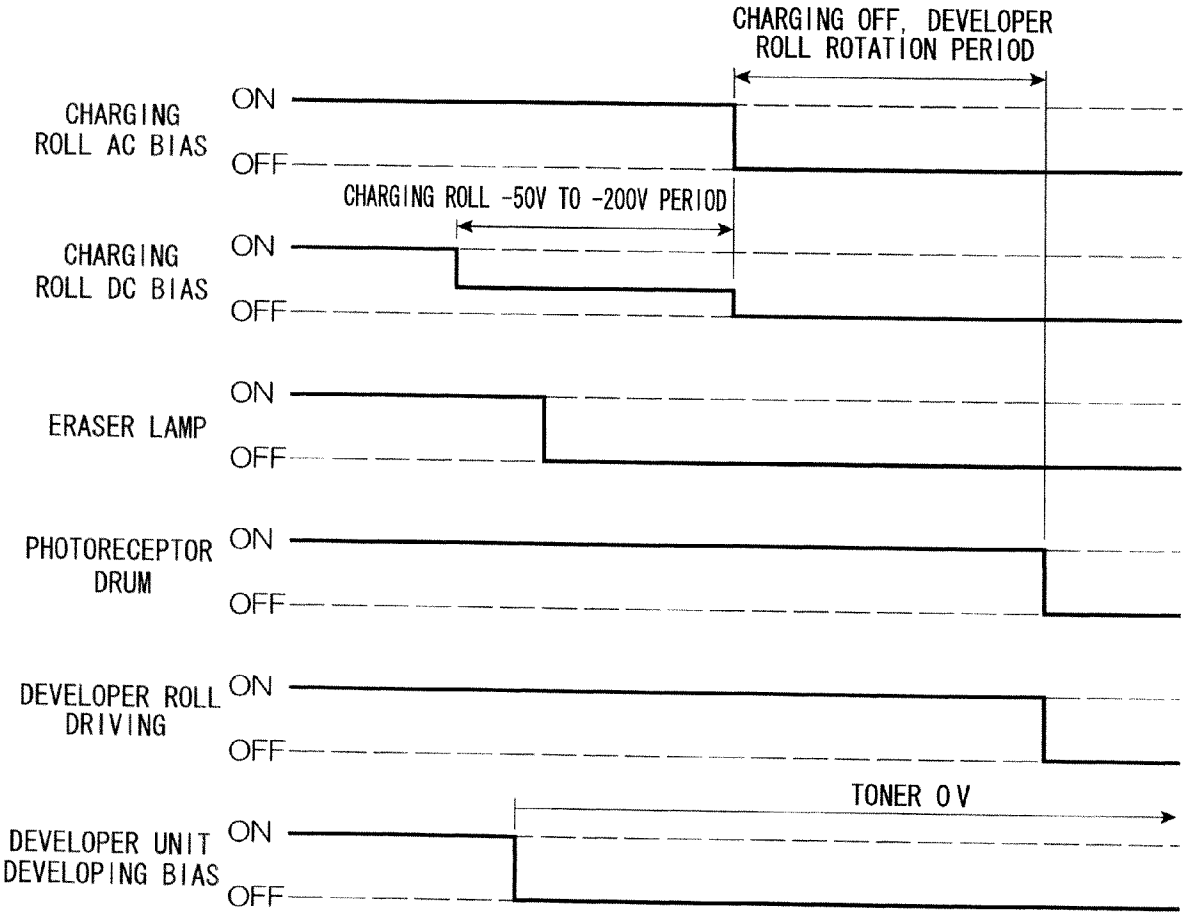
FIG. 8 is a timing chart showing the sequence of image forming unit charging and stopping driving, after image forming operation completion.

After the image forming operation is complete, as shown in the timing chart in FIG. 8, the controller 151 (see FIG. 5) first sends a signal to the charging power source 152 to lower the direct current voltage component of the oscillating voltage to between −50V and −200 V. Next, a signal for stopping applying a voltage is sent to the developing power source (not illustrated in the figures) which applies the developing bias within the developing unit 15, so that developing is stopped. Then a signal is sent to the lamp power source 156 to stop applying a voltage to the eraser lamp 170, and the eraser lamp 170 is stopped. Next, a signal is sent to the charging power source 152 to stop applying the oscillating voltage to the charging roll 13, and charging of the charging roll 13 is stopped. With respect to this, even if the photoreceptor surface 12A is not being charged by the charging roll 13, the photoreceptor surface 12A remains in a negative charged state for a while (for a period of time of the order of a few tens of seconds). At this time, the developing roll 18 is in a state in which voltage application from the motor power source 154 has not yet been stopped, and so continues to rotate by the drive motor 155 and while doing so supplies toner and lubricant of opposite polarity thereto onto the photoreceptor surface 12A. Consequently, the friction between the blade 42 and the photoreceptor surface 12A is reduced during later-rotation, since the lubricant continues to be supplied onto the photoreceptor surface 12A up to the time when the minus charge of the photoreceptor surface 12A has disappeared (0V). Also, as long as the potential of the photoreceptor surface 12A is between −50V and −200V, occurrences of toner flying on the photoreceptor surface 12A, "fogging", are suppressed.

Note that a period "prior to rotation" of the image carrier is from when a image forming start signal is received up until image forming starts, and a period "later rotation" of the image carrier is from completion of image forming operation up until the next image forming start signal is received.

The motor power source 160 for applying voltage to the drive motor 162 of the photoreceptor drum 12, the motor power source 154 for applying voltage to the drive motor 162 of the developing roll 18, and the developer charging power source of the developing unit 15, are all controlled by the controller 151 such that the voltage application is ceased until the minus charge of the photoreceptor surface 12A disappears.

Explanation will now be given of the operation of the first exemplary embodiment of the present exemplary embodiment.

When the image forming apparatus 150 is performing successive image forming, the adherent matter (residual toner and adherent matter) adhering to the photoreceptor surface 12A is separated from the photoreceptor surface 12A by the edge 42E of the blade 42, and pools to form a toner pool within the toner pooling region TP.

By the way, in the charging roll 13 as the contact type charger, although there is less ozone generated than with a non-contact type charger (corotron or scorotron), there is a lot of electrical discharge stress to the photoreceptor surface 12A, and there is a tendency for the coefficient of friction of the photoreceptor surface 12A to readily increase. If the coefficient of friction of the photoreceptor surface 12A rises, the free end of the blade 42 is dragged along by the rotation of the photoreceptor drum 12, and the force pulling the blade 42 toward the downstream side in the rotation direction of the photoreceptor drum 12 is applied to the toner in the toner pool, thereby, the edge 42E of the blade 42 is readily pushed way from the photoreceptor surface 12A. As a result the toner pool readily bursts through (toner slips past the edge 42E of the blade 42). However, in the image forming apparatus 150 of the present exemplary embodiment, the operation during non-image forming is executed during non-image forming (in the interval between formation of one image and formation of another image) and so the state of the toner pool that is tending toward bursting through is to some extent reset (moderated), since the coefficient of friction of the photoreceptor surface 12A is reduced. So, toner slipping past the blade 42 is consequently suppressed.

When, as in the present exemplary embodiment, an upward facing free end of the blade 42 with respect to vertical is used, the toner pool formed on the top side of the free end of the blade 42 has a poor turnover of toner, and due to the effect of gravity a strong force readily acts in the direction in which the toner pool bursts through, with a tendency for the toner pool to readily burst through. Therefore, the action of resetting the state of the toner pool in the present exemplary embodiment exhibits a good effect. In contrast, if a downward facing free end of a blade with respect to vertical is used, in the toner pool formed below the free end of the blade the toner readily falls due to gravity, so, a strong pressure (force) is not readily applied in the free end of the blade in the direction in which the toner pool bursts through. Accordingly, such an action is not obtained resetting the state of the toner pool as is achieved with an upward facing blade.

In addition electrical discharge stress received by the photoreceptor surface 12A is reduced since the controller 151 sets the value for multiplying the alternating current shoulder current value K as the multiplier ratio m' (non-image forming multiplier ratio) from the multiplier ratio m (image forming multiplier ratio), for during non-image forming (in the interval between formation of one image and formation of another image). Consequently the coefficient of friction of the photoreceptor surface 12A is reduced during the non-image forming periods. It should be noted that if the coefficient of friction of the photoreceptor surface 12A is lowered too much during image forming operation then this can lead to the required external additive (lubricant etc.) slipping through from the free end of the blade 42. Since this would worsen the cleaning ability of the blade 42, the action to lower the coefficient of friction of the photoreceptor surface 12A is preferably executed during non-image forming.

Also, application of the oscillating voltage to the charging roll 13 is ceased after stopping the eraser lamp 170 in the later-rotation period. With respect to this, even if the photoreceptor surface 12A is not being charged by the charging roll 13, the photoreceptor surface 12A still remains in a negative charged state for a while. Positive charged lubricant is supplied onto the photoreceptor surface 12A at this time by the developing roll 18. Then, the developing roll 18 is stopped, so, the coefficient of friction between the blade 42 and the photoreceptor surface 12A is lowered for the time up to when the developing roll 18 and the photoreceptor drum 12 are stopped.

In the first exemplary embodiment, the alternating shoulder current value K is set as the alternating current value at the point k when direct current value becomes constant, however, the present invention is not limited thereto. For example, a voltage detector may be provided for detecting the surface potential of the photoreceptor drum 12, the alternating current value of the oscillating voltage of the charging power source 152 is increased or decreased (varied), and the alternating current value derived at a point when the surface potential of the photoreceptor drum 12 becomes constant. This alternating current value may then be used as the alternating current shoulder current value.

In the first exemplary embodiment, the value for multiplying the alternating current shoulder current value K as the multiplier ratio m is set to the multiplier ratio m' (operation during non-image forming) for the interval between formation of one image and formation of another image during successive image forming, however, the present invention is not necessarily limited to such a configuration. The operation during non-image forming may be executed in the period prior to rotation or in the period later rotation. Further, the operation during non-image forming may be executed during all of the period prior to rotation, the period later rotation and the period between formation of one image and formation of another image in successive image forming or the operation during non-image forming may be executed during a combination of at least of two of these periods. Obviously, performing of the operation during later-rotation of the present exemplary embodiment is not limited to at the period later rotation of the photoreceptor drum 12 and may be executed during the period between formation of one image and formation of another image in successive image forming.

Furthermore, in the above exemplary embodiment the multiplier ratio for multiplying the alternating current shoulder current value K is different during image forming and during non-image forming, however, the present invention is not necessarily limited to such a configuration; for example a coating device (not shown in the figures) for coating the photoreceptor surface 12A with a lubricant (such as zinc stearate) may be provided between the transfer roll 16 and the cleaning device 40, such that a lubricant is coated on the photoreceptor surface 12A during non-image forming, thereby lowering the coefficient of friction of the photoreceptor surface 12A during non-image forming. In such a case it would obviously not be necessary to include lubricant in the developer.

Exemplary embodiments have been given above to explain the embodiment of the present invention, however, these are only examples of exemplary embodiments, and various modifications and variations are possible without departing from the spirit of the present invention. Obviously the scope of the present invention is not limited to the exemplary embodiments.

(Test)

Explanation will next be given of tests (Comparative Examples 1 and 2, and Example 1) which are performed to confirm the improved effect of the present invention using modified three copy-printer machines (DCC 450; manufactured by FUJIXEROX). The machines that are modified are common in that the DC current value flowing to the photoreceptor drum can be monitored while the AC current of the charging power source is increased or decreased (varied). The AC current value of the DC current value saturation point can thereby be measured.

(Test Condition)

In the tests, the image patterns are set with a successive image portion and a continuous non-image portion in the photoreceptor drum rotation axial direction, and a run test is executed equivalent to 30 KPV. The amounts of abrasion (wearing) at positions in the photoreceptor drum rotation axial direction on the surface of the photoreceptor drum for the number of cycles of the photoreceptor drum are measured, giving an abrasion rate of nm/kcycle. The environment conditions (temperature and humidity) in the tests are set at high temperature and high humidity (28° C., 85% RH) in which a compacted toner state is readily generated by the pool of the toner in the toner pooling region TP above the blade end portion, with the print conditions set with the print mode for 100 successive sheets of print.

Comparative Example 1

Figure 9:
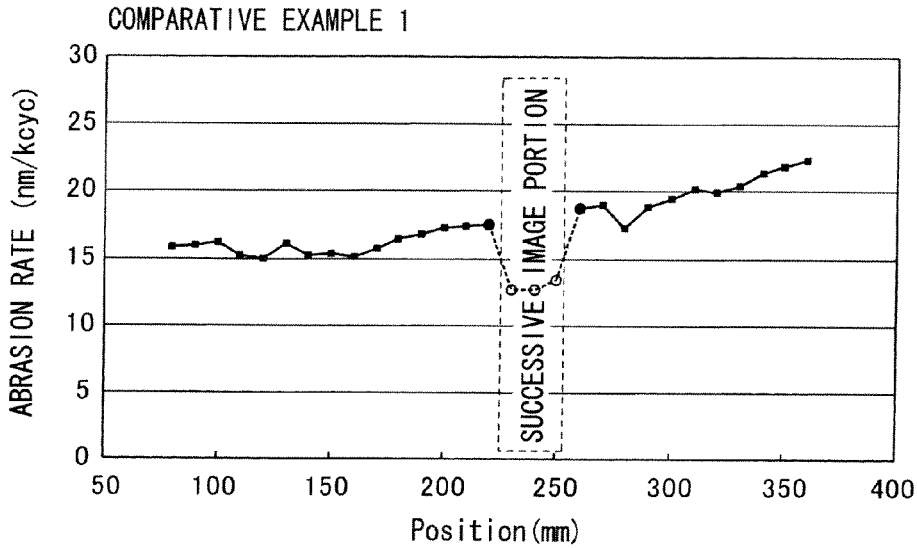
FIG. 9 is a graph showing the relationship between the position on the rotation axis of the photoreceptor drum and the wear rate in Comparative Example 1.

The modified machine of Comparative Example 1 is one in which a member equivalent to a dam member of the image forming apparatus of the first exemplary embodiment is removed, and the multiplier ratio is set to a constant value independent of whether operation is during image forming or during non-image forming. The charging condition of the photoreceptor drum is set such that a control current value $\alpha$ which is obtained by the AC current value K of the point k at which the DC current value is saturated being multiplied by a multiplier ratio of 1.28, is set as the AC current value of the oscillating voltage of the charging power source, and applied to the charging roll. Result of the test for Comparative Example 1 is shown in FIG. 9. In the Comparative Example 1 the abrasion rate is low in the successive image portion, i.e. uneven abrasion occurs, as shown in FIG. 9.

Comparative Example 2

Figure 10:
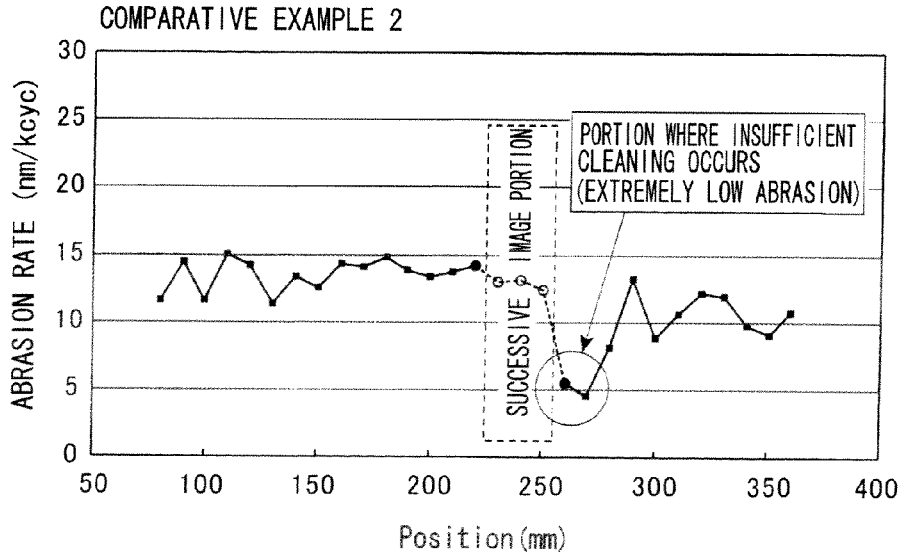
FIG. 10 is a graph showing the relationship between the position on the rotation axis of the photoreceptor drum and the wear rate in Comparative Example 2.

In the modified machine for Comparative Example 2, in the image forming apparatus of the first exemplary embodiment, the operation during non-image forming is removed. That is, the multiplier ratio is set to a specific constant value independent of whether operation is during image forming or non-image forming. The charging conditions of the photoreceptor drum are similar to those of Comparative Example 1. The result of Comparative Example 2 is shown in FIG. 10. As can be seen in the FIG. 10, the abrasion rate in the portions other than the successive image portion (in the continuous non-image portion) is reduced, and the difference to the successive image portion does not stand out. However, a portion of the continuous non-image portion has extremely low abrasion. On investigation, the portion of low abrasion is found to be minor but indicates that insufficient cleaning occurs.

Example 1

Figure 11:
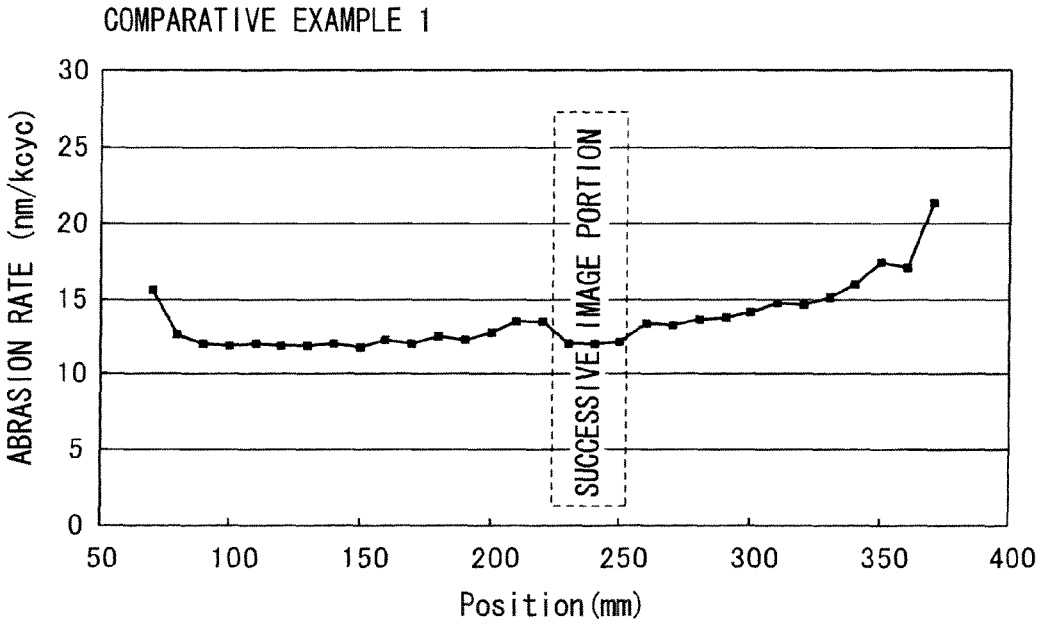
FIG. 11 is a graph showing the relationship between the position on the rotation axis of the photoreceptor drum and the wear rate in Example 1.

The modified machine of Example 1 is configured similar to that of the image forming apparatus of the first exemplary embodiment. The charging condition of the photoreceptor drum is set such that a control current value $\alpha$ is obtained by the AC current value K of the point k at which the DC current value is saturated being multiplied by a multiplier ratio of 1.28 during image forming, and a control current value $\alpha$ is obtained by the AC current value K of the point k at which the DC current value is saturated being multiplied by a multiplier ratio of 1.13 during non-image forming (charging condition which would generate a white spot, color spot, of about 1 mm), and each control current value $\alpha$ is set as the AC current value of the oscillating voltage of the charging power source, and applied to the charging roll. The result of Example 1 is shown in FIG. 11. As can be seen in FIG. 11, in Example 1 there is no occurrence of the extremely low abrasion in the continuous non-image portion that occurs in Comparative Example 2, and a uniform abrasion distribution occurs in the photoreceptor drum rotation axial direction, and both are achieved together in toner pool and a reduction in electrical discharge stress so maintaining the cleaning ability.

What is claimed is:

1. An image forming apparatus comprising:

a rotatable image carrier;

a charging unit that contacts a surface of the image carrier and charges the surface of the image carrier;

an exposing unit that exposes the surface of the image carrier and forms a latent image;

a developing unit that develops the latent image formed on the surface of the image carrier with a developer;

a transfer unit that transfers a developed toner image onto a transfer receiving member;

a cleaning unit that is provided with:

a plate shaped cleaning member having a free end that faces upward, a corner portion of the free end contacting the surface of the image carrier, the cleaning member cleaning off developer remaining on the surface of the image carrier after transfer by the transfer unit, and a developer pooling member provided between the cleaning member and the transfer unit, that temporarily pools the cleaned off developer at the free end of the cleaning member; and a friction coefficient reducing unit that reduces a friction coefficient at the surface of the image carrier, and that reduces the coefficient of friction during a non-image forming period to less than a coefficient of friction during an image forming period, the friction coefficient reducing unit including a current detector and a controller.

2. The image forming apparatus of claim 1, wherein the friction coefficient reducing unit that includes the controller controls a current or a voltage applied to the charging unit.

3. The image forming apparatus of claim 2, wherein:

in the charging unit, an oscillating voltage, in which a direct voltage is superimposed on an alternating voltage, is applied to the charging unit, and the controller controls the current applied to the charging unit so that an alternating current value during the non-image forming period is less than an alternating current value during the image forming period.

4. The image forming apparatus of claim 3, wherein the current detector detects a value of an alternating current shoulder current whose direct current component value changes, and which flows from the charging unit to the image carrier, and wherein the current applied to the charging unit during the image forming period is set to be an alternating current value which is obtained by the detected value of the alternating current shoulder current being multiplied by a multiplier ratio of from 1.2 to 1.4.

5. The image forming apparatus of claim 3, wherein the controller includes a current controller that applies the current to the charging unit such that an alternating current value during the non-image forming period is at least 15% less than an alternating current value during the image forming period.

6. The image forming apparatus of claim 1, wherein the non-image forming period is selected from at least one of:

a period prior to rotation of the image carrier, which is from when a image forming start signal is received up until image forming starts;

a period between formation of one image and formation of another image in successive image forming; and/or a period later rotation of the image carrier, which is from completion of the image forming up until a next image forming start signal is received.

7. The image forming apparatus of claim 6, wherein:

the developer includes a lubricant having an opposite polarity to a charge polarity of the image carrier during image forming;

the image forming apparatus further comprises a charge erasing unit provided between the transfer unit and the cleaning unit, that erases charge from the surface of the image carrier; and, in the period later rotation of the image carrier, applying developing bias in the developing unit is stopped, thereafter operation of the charge erasing unit is stopped, thereafter operation of the charging unit is stopped, and thereafter supplying of the developer by the developing unit is stopped.

8. An image forming method comprising the steps of:

rotating an image carrier;

charging a surface of the image carrier by a charging unit;

exposing the surface of the image carrier and forming a latent image;

developing the latent image formed on the surface of the image carrier with a developer;

transferring the developed developer image onto a transfer receiving member;

cleaning off developer that has remained on the surface of the image carrier after transfer, by a plate shape cleaning member having a free end that faces upward, a corner portion of the free end contacting the surface of the image carrier;

temporarily pooling the cleaned off developer on the free end of the cleaning member; and reducing a friction coefficient at the surface of the image carrier during a non-image forming period to less than a friction coefficient at the surface of the image carrier during an image forming period, wherein the step of reducing a friction coefficient includes detecting a current and controlling a current or voltage at the surface of the image carrier.

9. The image forming method of claim 8 wherein a current or a voltage applied to the charging unit is controlled to reduce a friction coefficient at the surface of the image carrier during the non-image forming period to less than a friction coefficient at the surface of the image carrier during the image forming period.

10. The image forming method of claim 9, wherein an oscillating voltage, in which a direct voltage is superimposed on an alternating voltage, is applied to the charging unit, and the current applied to the charging unit is controlled so that an alternating current value during the non-image forming period is less than an alternating current value during the image forming period.

11. The image forming method of claim 10, wherein:

a value of an alternating current shoulder current whose direct current component value changes, and which flows from the charging unit to the image carrier is detected, and the current applied to the charging unit during image forming period is set to be an alternating current value which is obtained by the detected value of the alternating current shoulder current being multiplied by a multiplier ratio of from 1.2 to 1.4.

12. The image forming method of claim 10, wherein the current is applied to the charging unit such that an alternating current value during the non-image forming period is at least 15% less than an alternating current value during the image forming period.

13. The image forming method of claim 8, wherein the non-image forming period is selected from at least one of:

a period prior to rotation of the image carrier, which is from when an image forming start signal is received up until image forming starts;

a period between formation of one image and formation of another image in successive image forming; and/or a period later rotation of the image carrier, which is from completion of the image forming up until a next image forming start signal is received.

14. The image forming method of claim 13, wherein:

the developer includes a lubricant having opposite polarity to a charge polarity of the image carrier during image forming; and the method further includes, in the following sequence, in the period later rotation of the image carrier, stopping applying the developing bias;

stopping erasing charge from the surface of the image carrier;

stopping operation of the charging unit;

stopping supplying of the developer.

* * * * *